US006763539B1

(12) United States Patent
Bartley et al.

(10) Patent No.: US 6,763,539 B1
(45) Date of Patent: Jul. 20, 2004

(54) NURSING PILLOW AND METHODS

(75) Inventors: Nancy Bartley, Golden, CO (US); Teresa Mead, Westminster, CO (US); Clarice Bonzer, Littleton, CO (US); Sheila Littlehorn, Littleton, CO (US)

(73) Assignee: The Boppy Company, Golden, CO (US)

( * ) Notice: Subject to any disclaimer, the term of this patent is extended or adjusted under 35 U.S.C. 154(b) by 0 days.

(21) Appl. No.: 10/426,067

(22) Filed: Apr. 28, 2003

(51) Int. Cl.[7] ..... A47C 20/02
(52) U.S. Cl. ..... 5/655; 5/652; 5/630
(58) Field of Search ..... 5/655, 652, 630, 5/636, 639; D6/601

(56) References Cited

U.S. PATENT DOCUMENTS

| | | | |
|---|---|---|---|
| 682,871 | A | 9/1901 | Hogan et al. |
| 1,343,357 | A | 6/1920 | Eggers |
| 2,328,871 | A | 9/1943 | Woehler |
| 2,961,668 | A | 11/1960 | Hayes |
| 3,667,074 | A | 6/1972 | Emery |
| 3,848,281 | A | 11/1974 | Mathews |
| 3,920,239 | A | 11/1975 | White |
| 4,161,794 | A | 7/1979 | Darnfors |
| 4,197,604 | A | 4/1980 | Nakamura |
| D255,966 | S | 7/1980 | Stadel |
| 4,227,270 | A | 10/1980 | Rivera |
| 4,236,264 | A | 12/1980 | Britzman |
| 4,345,347 | A | 8/1982 | Kantor |
| 4,434,513 | A | 3/1984 | Welch |
| 4,731,890 | A | 3/1988 | Roberts |
| 4,858,259 | A | 8/1989 | Simmons et al. |
| 5,029,350 | A | 7/1991 | Edelson |
| 5,056,533 | A | 10/1991 | Solano |
| 5,134,740 | A | 8/1992 | Summer |
| 5,154,649 | A | 10/1992 | Pender |
| 5,193,235 | A | 3/1993 | Kircher |
| 5,257,429 | A | 11/1993 | Genis |
| 5,261,134 | A | 11/1993 | Matthews |
| 5,313,678 | A | 5/1994 | Redewill |
| D348,174 | S | 6/1994 | Genis |
| D352,633 | S | 11/1994 | Berggren |
| D360,554 | S | 7/1995 | Righini |
| 5,519,906 | A | 5/1996 | Fanto-Chan |
| 5,546,620 | A | 8/1996 | Matthews |
| 5,581,833 | A | 12/1996 | Zenoff |
| D377,881 | S | 2/1997 | Watt |
| 5,661,861 | A | 9/1997 | Matthews |

(List continued on next page.)

FOREIGN PATENT DOCUMENTS

| | | |
|---|---|---|
| DE | 42 05 650 A1 | 11/1993 |
| EP | 1 306 034 A1 | 5/2003 |
| FR | 1.430.355 | 1/1966 |
| FR | 2 379 268 | 9/1978 |
| GB | 215848 | 5/1924 |
| GB | 1 508 809 | 4/1978 |
| GB | 2 198 341 A | 6/1988 |
| GB | 2 205 236 A | 12/1988 |
| WO | WO 02/21978 A2 | 3/2002 |
| WO | WO 02/21979 A1 | 3/2002 |
| WO | WO 02/28232 A1 | 4/2002 |

*Primary Examiner*—Teri Pham Luu
(74) *Attorney, Agent, or Firm*—Townsend and Townsend and Crew LLP

(57) ABSTRACT

In one embodiment, a pillow comprises a pillow body comprising a medial region and two opposing arms with ends extending from the medial region to define an inner well region. The pillow body is sized and configured to permit the medial region to rest on a user's lap, with the ends of the opposing arms being generally adjacent to the user's waist. A support member is disposed across at least a portion of the well region such that the ends of the arms extend beyond the support member. The support member is sized and configured to assist in supporting a baby when lying on the pillow body while the ends of the arms are generally adjacent to the user's waist.

30 Claims, 4 Drawing Sheets

U.S. PATENT DOCUMENTS

| | | | | | |
|---|---|---|---|---|---|
| 5,702,153 | A | | 12/1997 | Pliska | |
| D393,772 | S | | 4/1998 | Vingino | |
| 5,790,999 | A | | 8/1998 | Clark | |
| D416,159 | S | | 11/1999 | Porter | |
| 5,979,981 | A | | 11/1999 | Dunne et al. | |
| 6,038,720 | A | | 3/2000 | Matthews et al. | |
| 6,052,848 | A | | 4/2000 | Kelly | |
| 6,055,687 | A | | 5/2000 | Matthews | |
| 6,079,067 | A | * | 6/2000 | Becker et al. | 5/655 |
| 6,119,873 | A | | 9/2000 | Matthews | |
| 6,217,336 | B1 | | 4/2001 | Matthews | |
| 6,233,767 | B1 | | 5/2001 | Horowitz | |
| 6,279,185 | B1 | | 8/2001 | Matthews | |
| 6,321,403 | B1 | | 11/2001 | Matthews | |
| 6,354,665 | B1 | | 3/2002 | Ross | |
| 6,412,128 | B1 | | 7/2002 | Matthews | |
| 6,434,770 | B2 | | 8/2002 | Matthews Brown | |
| 6,453,493 | B1 | | 9/2002 | Matthews Brown | |
| 6,487,737 | B1 | | 12/2002 | Futagami | |
| 6,499,165 | B1 | * | 12/2002 | Morgillo | 5/655 |
| 6,523,200 | B2 | | 2/2003 | Brown | |
| 6,532,612 | B2 | | 3/2003 | Matthews Brown | |
| 6,553,590 | B1 | * | 4/2003 | Leach | 5/655 |
| 6,625,828 | B2 | | 9/2003 | Brown | |
| 2002/0014436 | A1 | | 2/2002 | Mathews Brown | |

* cited by examiner

NURSING PILLOW AND METHODS

BACKGROUND OF THE INVENTION

This invention relates generally to the field of support pillows, and in particular to support pillows useful in supporting infants, babies and other items. In one particular application, the support pillows may be useful in holding a baby while feeding the baby.

When feeding a baby, some type of support typically needs to be provided. For example, one common technique used in breast feeding is to position the baby lengthwise across the mother while holding the baby in the mother's arms. A similar position may be used when bottle feeding except that the baby's head may be rested in the crook of the feeder's arm while the rest of the body rests on the feeder's lap.

In either case, supporting the baby while feeding can tire and fatigue the feeder, especially if feeding is prolonged or is required numerous times throughout the day. To help support the baby, a variety of pillows have been proposed including, for example, those described in U.S. Pat. Nos. 5,661,861; 5,581,833 and 5,519,906, the complete disclosures of which are herein incorporated by reference.

BRIEF SUMMARY OF THE INVENTION

This invention is related to other types of support pillows that may be used to facilitate feeding of a baby, among other uses. In one embodiment, the invention provides a nursing pillow that comprises a pillow body having a medial region and two opposing arms with ends extending from the medial region to define an inner well region. The pillow body is sized and configured to permit the medial region to rest on a user's lap, with the ends of the opposing arms being generally adjacent to the user's waist. A support member is disposed across at least a portion of the well region such that the ends of the arms extend beyond the support member. Further, the support member is sized and configured to assist in supporting a baby when lying on the pillow body while the ends of the arms are generally adjacent to the user's waist. Hence, such a pillow may be used to facilitate the feeding of a baby by placing the baby onto the pillow, with the baby's bottom or hip resting on the support member and the upper body being supported by one or more of the arms and/or medial region.

In one aspect, the support member may comprise a piece of fabric extending across the well region. Conveniently, the piece of fabric may be generally aligned with a midplane of the pillow body. In another aspect, the pillow body may be constructed of a fill material that is enclosed in a fabric cover, and the support member may comprise a continuation of the fabric cover that extends across the well region.

The dimensions of the support pillow are selected so that the pillow may conveniently fit on the user's lap while also providing the proper position for the baby, such as when feeding or holding the baby. For example, the pillow body may have a thickness in the range from about 3 includes to about 9 inches, and more preferably from about 5 inches to about 7 inches. The well region may have a width in the range of 6 inches to about 9 inches, and more preferably from about 7 inches to about 8 inches. Also, the well region may have a depth in the range of about 9 inches to about 14 inches, and the support member may have a depth in the range from about 4 inches to about 8 inches. The opposing arms may each have a width in the range from about 6 inches to about 12 inches, and more preferably from about 8 inches to about 10 inches. In some cases, the arms may have a variable width. The medial region may further have a depth in the range from about 5 inches to about 9 inches, and more preferably from about 6 inches to about 8 inches.

The support member may also have an edge that is configured to rest against the user's stomach. Conveniently, the edge may be curved in geometry. The ends of the arms may also be curved in geometry. In one aspect, the pillow body may be U-shaped in geometry.

The invention in another embodiment provides a method for supporting a baby. The method may utilize a pillow comprising a pillow body having a medial region and two opposing arms extending from the medial region to define an inner well region. A support member is disposed across at least a portion of the well region. The pillow body is placed on a user's lap, with the opposing arms being generally adjacent to the user's waist, and a baby is placed onto the support pillow, with at least some of the baby's weight being supported by the support member.

In one arrangement, the baby may be placed onto the pillow such that the baby's bottom or hip is positioned on the support member. In this way, the baby's chest and head are somewhat elevated and may also be in contact with the user's chest. Such an arrangement may be particularly useful when bottle feeding, breast feeding, or simply holding the baby, especially when sleeping. Further, in cases where the baby is congested, elevating the baby's chest and head may help the baby breath easier.

The pillow may also be used for resting at least one of the user's arms to help prevent the arms from becoming fatigued.

DETAILED DESCRIPTION OF THE INVENTION

The invention provides embodiments of support pillows and methods for their use. In some embodiments, the pillows may be configured to extend at least partially around the user's waste while also providing an inner well region that is disposed over the user's lap. A support member may extend across at least a portion of the well region and may be used to help hold a baby when lying on the pillow. For instance, the baby's mid section may be held by the support member while the baby's chest and/or head may be supported by the pillow. In this way, the pillow may be used to hold the baby when bottle feeding, breast feeding, sleep, or simply lying. Further, the pillow may be used to hold other items as well, such as food, books, magazines, games, computers, electronic controls, and the like.

The support pillows are particularly useful when the user is in a sitting position so that the pillow may be held across the user's lap. Optionally, a strap may be connected to the ends of the pillows arms and extend around the user's waist to help hold the pillow to the user, especially when the user stands or moves around in a chair or couch.

The support pillows are configured such that they easily fit the shape of essentially any waist by having the arms of the pillow terminate at the user's side. At the same time, the support member provides sufficient support for the baby. Such a configuration also helps the user to be positioned in an ergonomically correct orientation while nursing or feeding the baby. Another feature is that the support pillow may be sized to fit within a rocking chair while also being large enough to properly support the baby. The contoured nature of the pillow also allows the pillow to sit close to the user while resting comfortably on the user's lap, such as when feeding. The slightly sloping sides of the pillow body also elevates the baby's back and head to facilitate nursing.

Figure 1:
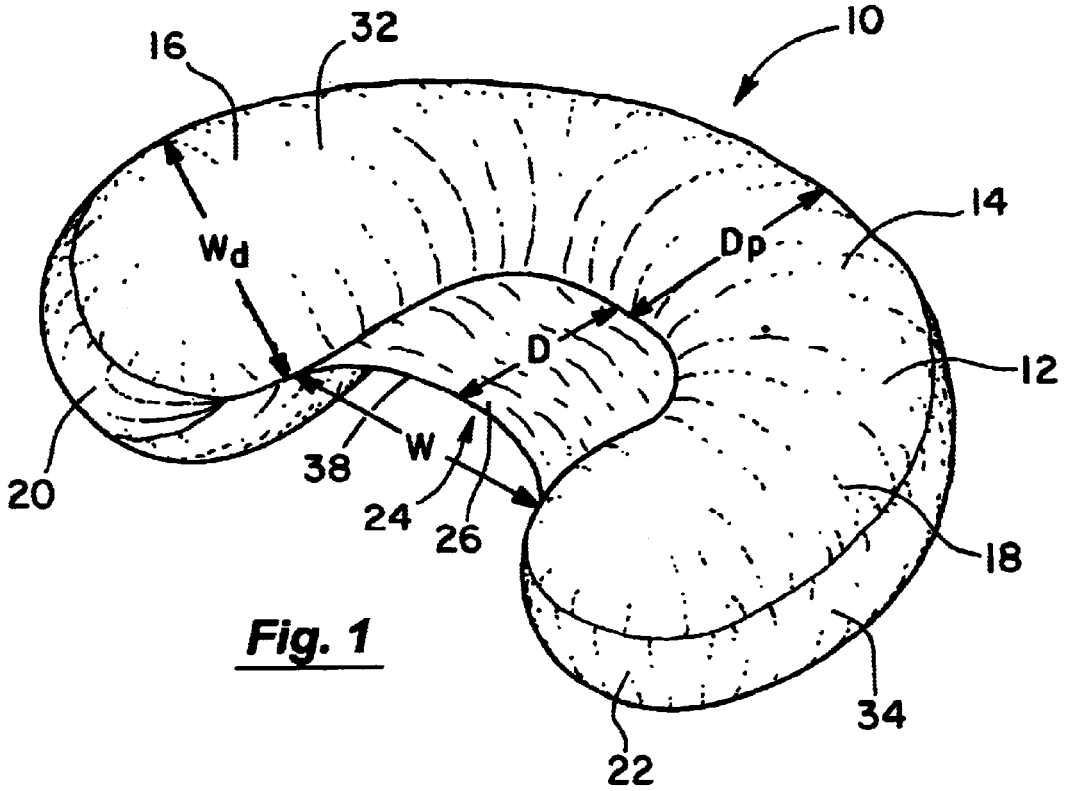
FIG. 1 is a perspective view of one embodiment of a support pillow according to the invention.
Figure 2:
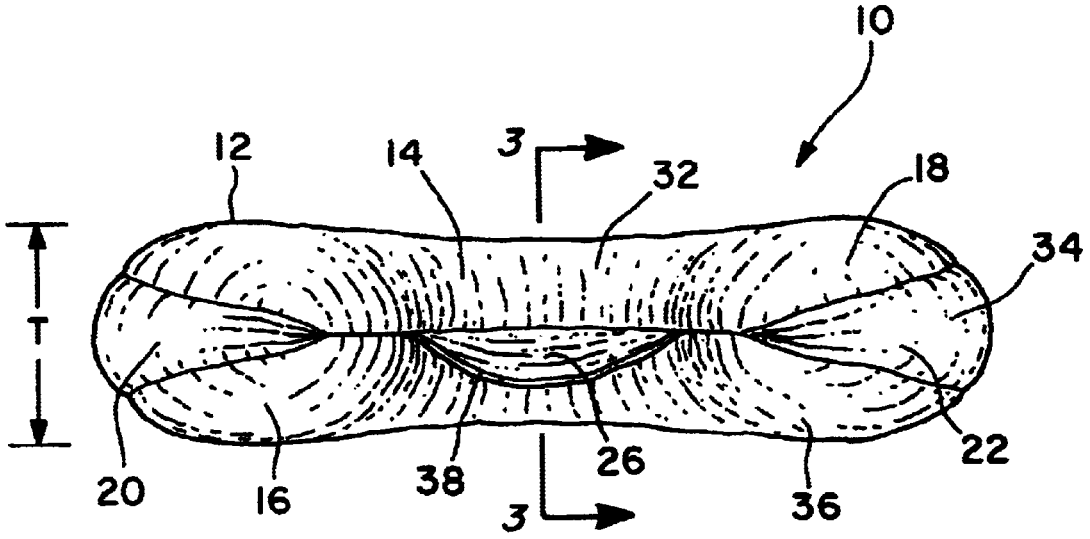
FIG. 2 is a front view of the pillow of FIG. 1.
Figure 3:
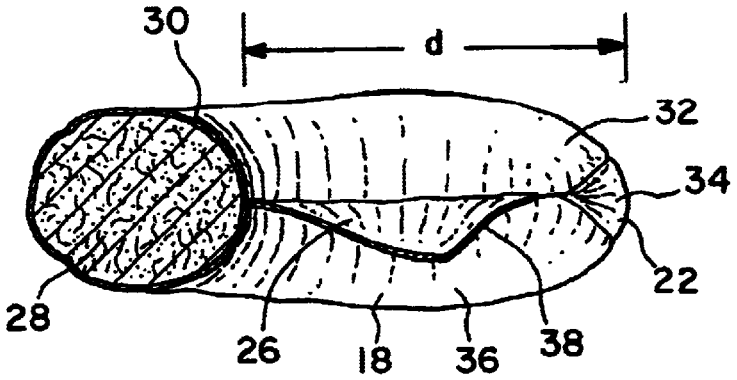
FIG. 3 is a cross sectional side view of the pillow of FIG. 2 taken along lines 3—3.

Referring now to FIGS. 1–3, one embodiment of a support pillow 10 will be described. Support pillow 10 comprises a pillow body 12 that may be generally defined in terms of a medial region 14 and two opposing arms 16 and 18 having ends 20 and 22, respectively. The medial region 14 together with arms 16 and 18 partially surround and define a well region 24. Disposed across a portion of well region 24 is a support member 26 that is designed to assist in supporting some or all of an object resting on pillow 10.

As best shown in FIG. 3, pillow body 12 may be constructed of a fill material 28 that is covered with a fabric cover 30. The fill material 28 may comprise essentially any type of material that is safe to be used with humans and that provides the necessary firmness for pillow 10. Examples of fill materials include fibers, foams, feathers, and the like. Fabric cover 30 may comprise essentially any type of fabric that is safe to be used around babies, such as cotton and polyester fabrics. The pillow body may be filled with a sufficient amount of fill material 28 so that it is relatively firm. In this way, when a baby rests on pillow body 12, it only slightly deforms.

To facilitate manufacturing, cover 30 may be constructed of a top piece 32, a middle piece 34 and a bottom piece 36. These pieces may be sewn together along seam lines to enclose the fill material 28. Use of middle piece 34 also provides pillow 10 with greater flexibility so that arms 16 and 18 may be manipulated without causing buckling of the pillow body 12. Conveniently, support member 26 may be a continuation of top piece 32 and bottom piece 36 that are sewn together along the inner edges of arms 16 and 18, along medial region 14 and along an outer edge 38 of support member 26. However, it will be appreciated that other methods of constructing support member 26 may be used as well. For example, support member 26 may comprises a separate piece of fabric. As another example, support member 26 could be constructed of a mesh material, netting, it may have holes or it may include a fill material as well. Support member 26 may be constructed of a non-stretchable material or a stretchable material to permit arms 16 and 18 to be further separate from each other.

A shown in FIG. 2, support member 38 slightly droops. In this way, a seat is formed in the inner well region for receiving the baby's bottom while the upper torso and head are elevated by the pillow body. Also, such a configuration is comfortable for the baby.

In some cases, support pillow 10 may be constructed using materials and techniques similar to those described in U.S. Pat. Nos. 5,261,134; 5,546,620; 5,661,861; 6,038,720; 6,055,687; 6,434,770; 6,532,612; 6,279,185; and 6,412,128, the complete disclosures of which are herein incorporated by reference. Also, it will be appreciated that pillow 10 could be constructed to be inflatable as well.

As best shown in FIG. 1, outer edge 38 of support member 26 is curved and is designed to rest against the user's stomach. This permits pillow body 12 to sit closer to the user, such as when the pillow 10 sits on the user's lap when feeding a baby. Ends 16 and 18 may conveniently be curved, or they may have other shapes as well, such as straight. In some cases, outer edge 38 is spaced apart from ends 16 and 18, such as by a distance in the range from about 1 inch to about 8 inches. Such a design enables the ends 16 and 18 to be positioned adjacent the user's sides while outer edge 38 is generally adjacent to the user's stomach. In this way, well region 24 is moved closer to the user.

Figure 4:
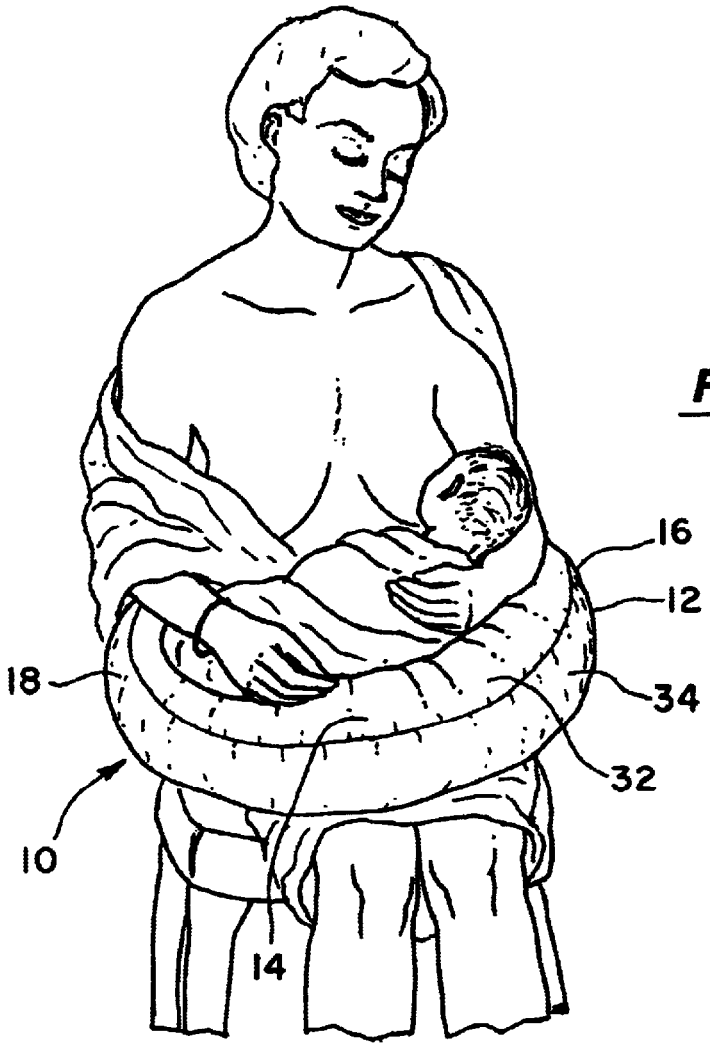
FIG. 4 illustrates the pillow of FIG. 1 when used for nursing a baby according to the invention.

Pillow 10 may be generally U-Shaped in geometry so that medial region 14 rests on the user's lap while arms 16 and 18 are generally positioned adjacent to the user's sides as illustrated in FIG. 4. Although the outer shape is generally a continuous curve, it will be appreciated that other shapes may be used as well, such as a pillow having corners where the arms and medial region intersect.

Arms 16 and 18 and medial region 14 may be constructed so that they are generally curved to form slightly sloping surfaces down to support member 26. In this way, the slight slope elevates the baby's back and head for easy nursing as illustrated generally in FIG. 4. Further, the arms 16 or 18 may be used to help hold the user's arm when nursing or feeding the baby. When nursing or feeding a baby, support member 26 provides support for the baby's bottom or hip, and the sloping surfaces of the opposite arm 16 or 18 and medial region 14 help hold the baby in place so that the baby will not slide or move around during feeding. Hence, as shown in FIG. 4, a user may nurse a baby while sitting upright in an ergonomically correct position, with the user's arms resting on arms 16 and 18. Further, the baby's mouth is properly positioned in front of the mother's breast so that the mother may comfortably nurse the baby. The sloping surfaces of the pillow body properly orient the baby while also holding the baby in the proper position.

As previously described, the dimensions of the support pillow 10 may be selected so that the pillow 10 may conveniently fit on the user's lap while also providing the proper position for the baby, such as when feeding or holding the baby as illustrated in FIG. 4. For example, the pillow body 12 may have a thickness T (see FIG. 2) in the range from about 3 includes to about 9 inches, and more preferably from about 5 inches to about 7 inches. The well region 24 may have a width W (see FIG. 1) in the range of 6 inches to about 9 inches, and more preferably from about 7 inches to about 8 inches. Also, the well region 24 may have a depth d (see FIG. 3) in the range of about 9 inches to about 14 inches, and the support member 26 may have a depth D (see FIG. 1) in the range from about 4 inches to about 8 inches. The opposing arms 16 and 18 may each have a width Wd in the range from about 6 inches to about 12 inches, and more preferably from about 8 inches to about 10 inches, which may vary over the length of the arms. The medial region 14 may further have a depth Dp in the range from about 5 inches to about 9 inches, and more preferably from about 6 inches to about 8 inches.

Such dimensions are particularly well suited when pillow 10 is used to facilitate nursing or feeding of a baby. However, it is conceivable that smaller or larger pillows could be used for other applications. For example, a smaller pillow could be made as a toy.

Figure 5:
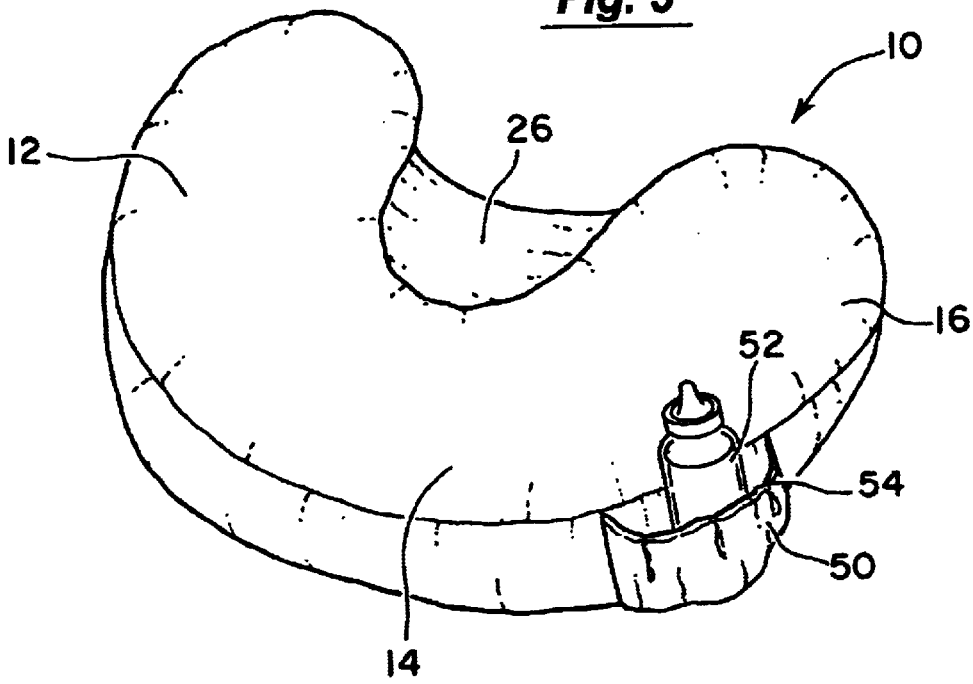
FIG. 5 illustrates another embodiment of a support pillow according to the invention.

The pillows of the invention may also include various pockets to hold a wide assortment of items, such as bottles, pacifiers, toys, rattles, drinks, phones, food and the like. As shown in FIG. 5, pillow 10 has been modified to include a pocket 50 that is shown holding a bottle 52. Pocket 50 may conveniently be formed of a fabric that may be attached to pillow 10 using a variety of fastening devices, such as thread, snaps, a hook and loop fastener material, buttons, glue or the like. Further, the size and location of pocket 50 may vary depending on the size of the item or items to be held. Optionally, the top end of pocket 50 may include an elastic material 54 to help hold items within the pocket.

Figure 6:
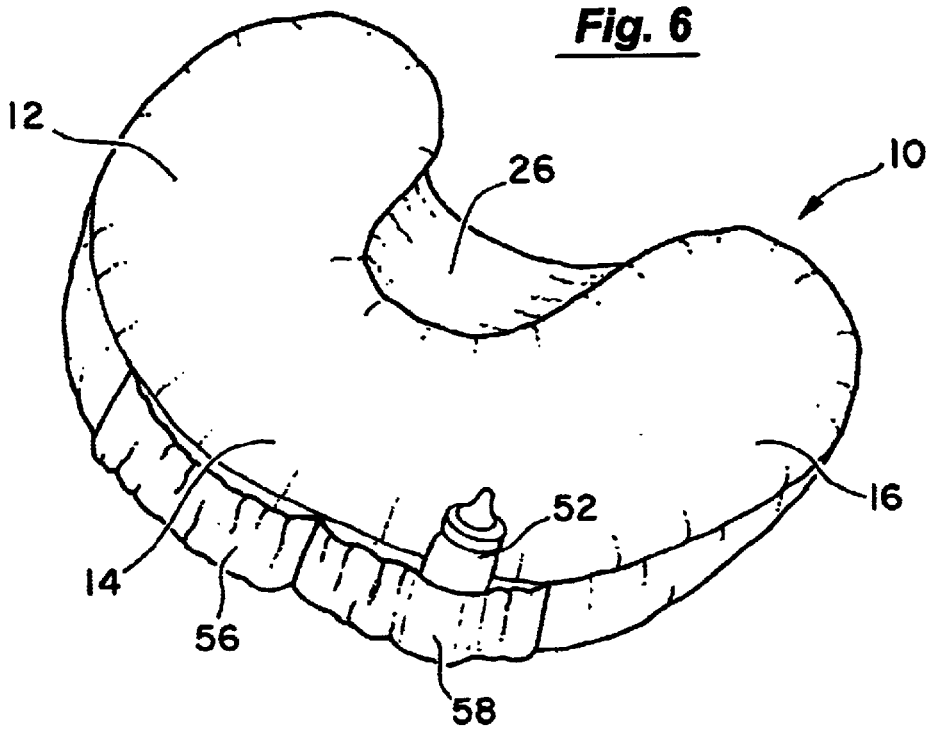
FIG. 6 illustrates a further embodiment of a support pillow according to the invention.
Figure 7:
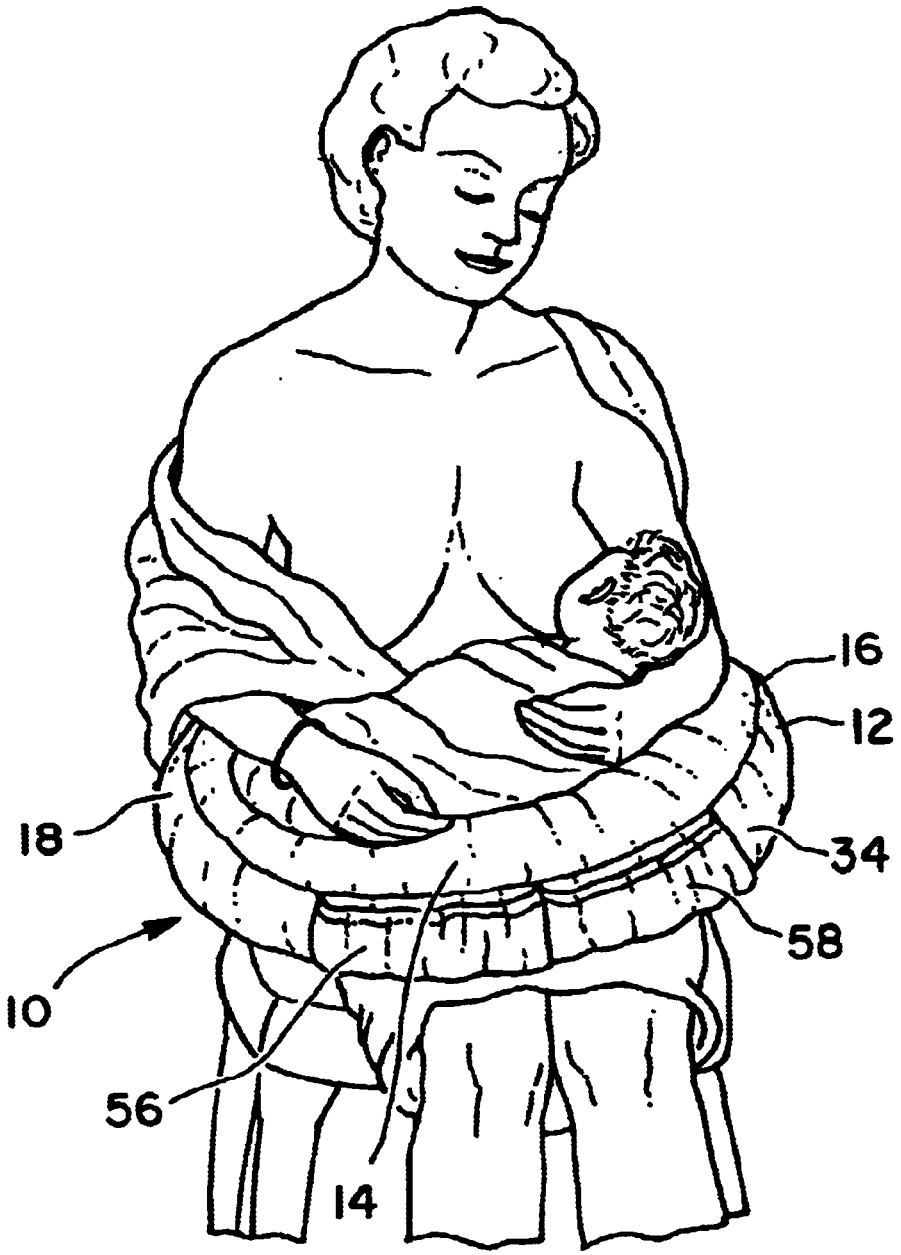
FIG. 7 illustrates the pillow of FIG. 5 when use for nursing a baby according to the invention.

As shown in FIG. 6, pillow 10 may be modified to include multiple pockets. As shown, pillow 10 has pockets 56 and 58. These are disposed at the medial region; however, it will be appreciated that they may be located at other areas as well. FIG. 7 illustrates the pillow of FIG. 6 when using by a nursing mother.

The invention has now been described in detail for purposes of clarity and understanding. However, it will be appreciated that certain changes and modifications may be practiced within the scope of the appended claims.

What is claimed is:

1. A nursing pillow comprising:

a pillow body comprising a medial region and two opposing arms with ends extending from the medial region to define an inner well region, wherein the pillow body is sized and configured to permit the medial region to rest on a user's lap, with the ends of the opposing arms being generally adjacent to the user's waist; and a support member disposed across at least a portion of the well region such that the ends of the arms extend beyond the support member, wherein the support member is sized and configured to assist in supporting a baby when lying on the pillow body while the ends of the arms are generally adjacent to the user's waist.

2. A nursing pillow as in claim 1, wherein the support member comprises a piece of fabric extending across the well region.

3. A nursing pillow as in claim 2, wherein the piece of fabric is generally aligned with a midplane of the pillow body.

4. A nursing pillow as in claim 1, wherein pillow body comprises a fill material enclosed in a fabric cover, and wherein the support member comprises a continuation of the fabric cover that extends across the well region.

5. A nursing pillow as in claim 1, wherein the pillow body has a thickness in the range from about 3 includes to about 9 inches.

6. A nursing pillow as in claim 1, wherein the pillow body has a thickness in the range from about 5 inches to about 7 inches.

7. A nursing pillow as in claim 1, wherein the well region has a width in the range of 6 inches to about 9 inches.

8. A nursing pillow as in claim 1, wherein the well region has a width in the range of 7 inches to about 8 inches.

9. A nursing pillow as in claim 1, wherein the well region has a depth in the range of about 9 inches to about 14 inches, and wherein the support member has a depth in the range from about 4 inches to about 8 inches.

10. A nursing pillow as in claim 1, wherein the support member has an edge that is configured to rest against the user's stomach, and wherein the edge is curved in geometry.

11. A nursing pillow as in claim 1, wherein the opposing arms each have a width in the range from about 6 inches to about 12 inches.

12. A nursing pillow as in claim 1, wherein the opposing arms each have a width in the range from about 8 inches to about 10 inches, and wherein the width varies along the arms.

13. A nursing pillow as in claim 1, wherein the ends of the arms are curved.

14. A nursing pillow as in claim 1, wherein the pillow body is U-shaped in geometry.

15. A nursing pillow as in claim 1, wherein the medial region has a depth in the range from about 5 inches to about 9 inches.

16. A nursing pillow as in claim 1, wherein the medial region has a depth in the range from about 6 inches to about 8 inches.

17. A nursing pillow as in claim 1, further comprising at least one pocket coupled to the pillow body.

18. A method for supporting a baby, the method comprising:

providing a pillow comprising a pillow body having a medial region and two opposing arms extending from the medial region to define an inner well region, and a support member disposed across at least a portion of the well region;

placing the pillow body on a user's lap, with the opposing arms being generally adjacent to the user's waist;

placing a baby onto the support pillow, with at least some of the baby's weight being supported by the support member.

19. A method as in claim 18, wherein the baby's bottom or hip is positioned on the support member, and further comprising nursing the baby.

20. A method as in claim 18, further comprising resting at least one of the user's arms on one of the opposing arms of the pillow body.

21. A method as in claim 18, wherein the support member comprises a piece of fabric extending across the well region, and wherein the baby's bottom is placed onto the piece of fabric.

22. A method as in claim 18, wherein pillow body comprises a fill material enclosed in a fabric cover, wherein the support member comprises a continuation of the fabric cover that extends across the well region, and further comprising positioning the piece of fabric adjacent to the user's stomach.

23. A method as in claim 18, wherein the pillow body has a thickness in the range from about 3 includes to about 9 inches, wherein the well region has a width in the range of 6 inches to about 9 inches, wherein the well region has a depth in the range of about 9 inches to about 14 inches, wherein the support member has a depth in the range from about 4 inches to about 8 inches, and wherein the opposing arms each have a width in the range from about 6 inches to about 12 includes, and further comprising resting the opposing arms on the user's legs.

24. A method as in claim 18, wherein the support member has an edge that is curved in geometry and further comprising placing the edge against the user's stomach.

25. A method as in claim 18, wherein the arms each have curved ends that extend beyond the support member, and further comprising positioning the ends such that they are generally adjacent to the user's waist.

26. A method as in claim 18, wherein the pillow body is U-shaped in geometry, and further comprising resting the opposing arms on the user's legs while the user is sitting.

27. A method as in claim 18, wherein the medial region has a depth in the range from about 5 inches to about 9 inches, and further comprising placing the medial region across the user's legs.

28. A method as in claim 18, further comprising breast feeding the baby while lying on the pillow.

29. A method as in claim 18, further comprising bottle feeding the baby while lying on the pillow.

30. A method as in claim 18, further comprising storing an item in a pocket that is coupled to the pillow body.

* * * * *